United States Patent [19]

Roberts

[11] 4,375,255

[45] Mar. 1, 1983

[54] COIN HANDLING APPARATUS FOR A VENDING MACHINE

[76] Inventor: Glenn M. Roberts, 4169 Avenida Madrid, Cypress, Calif. 90630

[21] Appl. No.: 251,149

[22] Filed: Apr. 6, 1981

[51] Int. Cl.[3] ..... G07F 5/04

[52] U.S. Cl. ..... 194/1 G; 194/97 R

[58] Field of Search ..... 194/1 C, 1 G, DIG. 2, 194/97 R, DIG. 17, 1 D; 206/63.3

[56] References Cited

U.S. PATENT DOCUMENTS

| | | | |
|---|---|---|---|
| 965,290 | 7/1910 | Garson | 194/DIG. 17 |
| 967,725 | 8/1910 | Carnell | 194/1 G |
| 1,926,232 | 9/1933 | Gilmore | 194/1 D |
| 2,076,513 | 4/1937 | Hoban | 194/DIG. 17 |

*Primary Examiner*—Stanley H. Tollberg

*Attorney, Agent, or Firm*—Fulwider, Patton, Rieber, Lee & Utecht

[57] ABSTRACT

A coin handling apparatus for a coin-operated stamp vending machine. The coin handling apparatus is adjustable to permit operation of the vending machine by a single coin or a plurality of coins. This arrangement permits the machine to be set to dispense items of different monetary values. The adjustment of the apparatus with respect to the number of coins required to vend may be easily made in the field so as to eliminate the necessity of removing the vending machine from its operative location. An arrangement is also provided for locking out a coin when the operating lever is moved too quickly. This insures that an item will be dispensed each time the vending machine is operated.

13 Claims, 19 Drawing Figures

FIG. 1
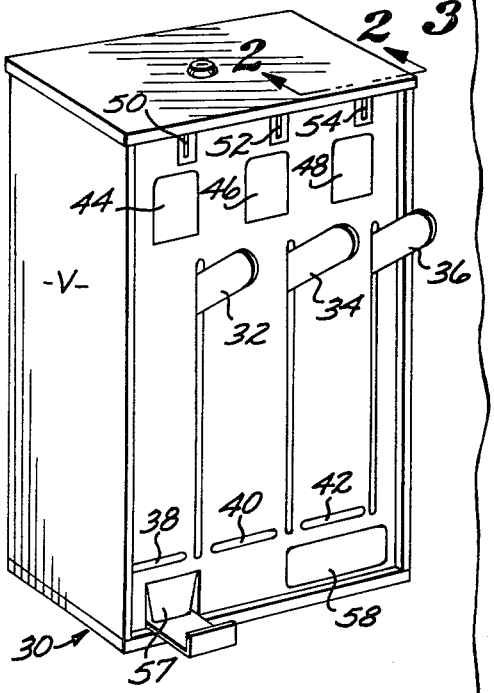
FIG. 2
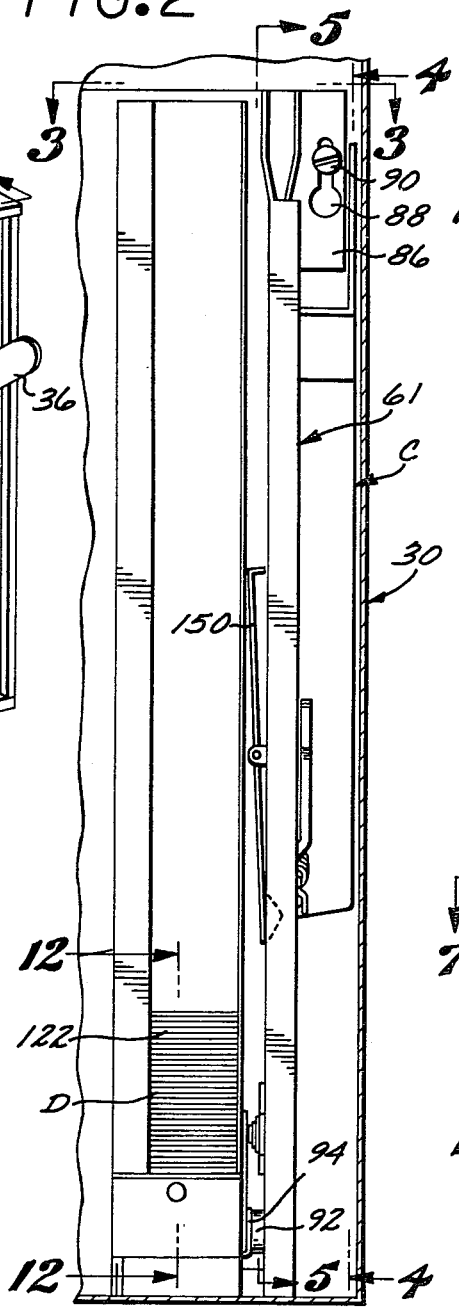
FIG. 6
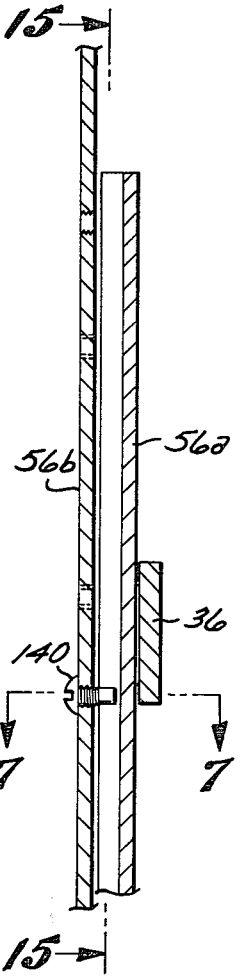
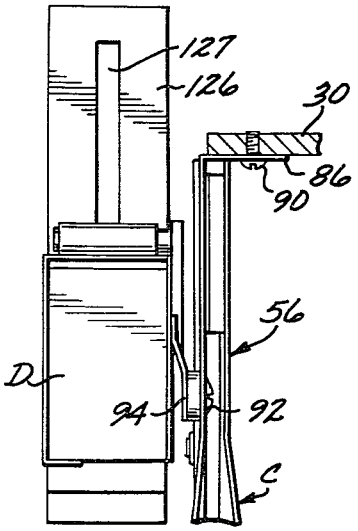
FIG. 3
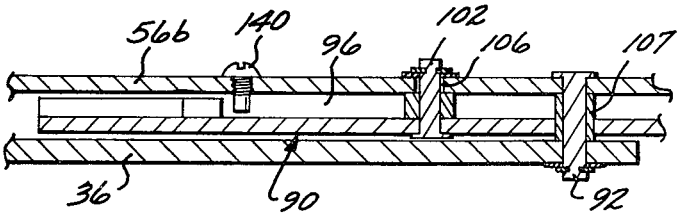
FIG. 7

FIG. 10
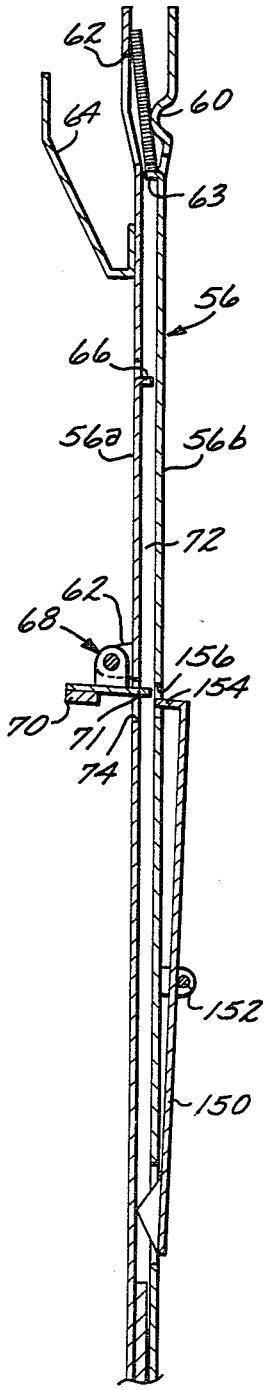
FIG. 11
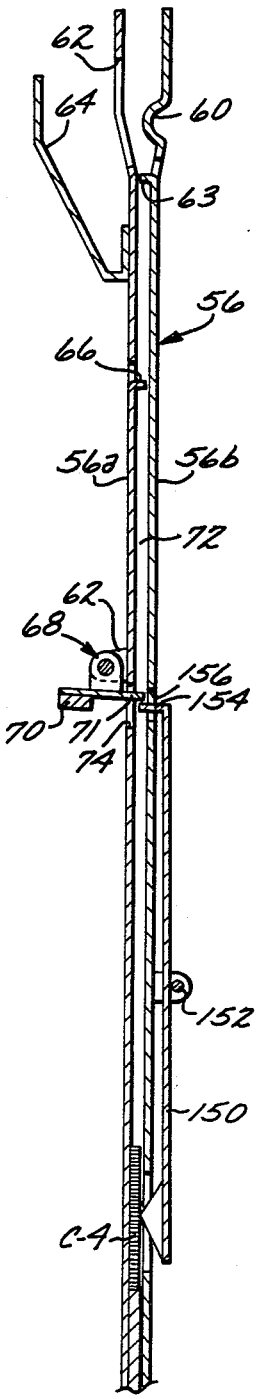
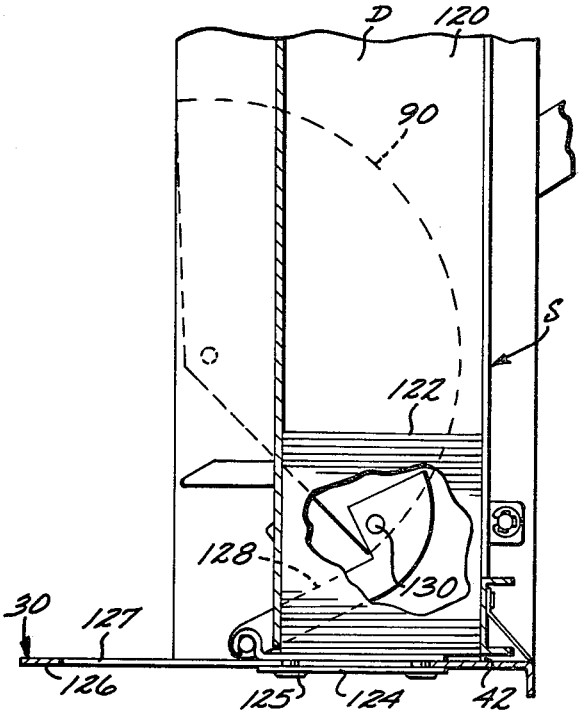
FIG. 12
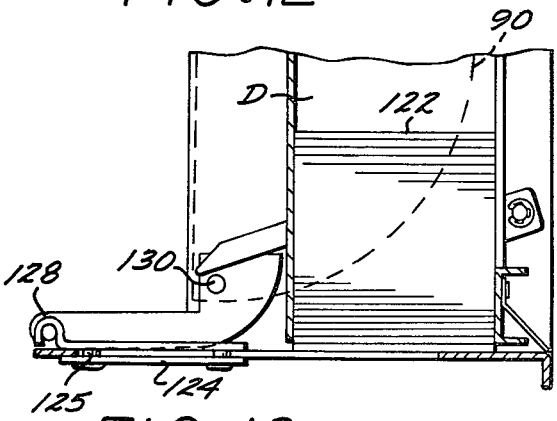
FIG. 13
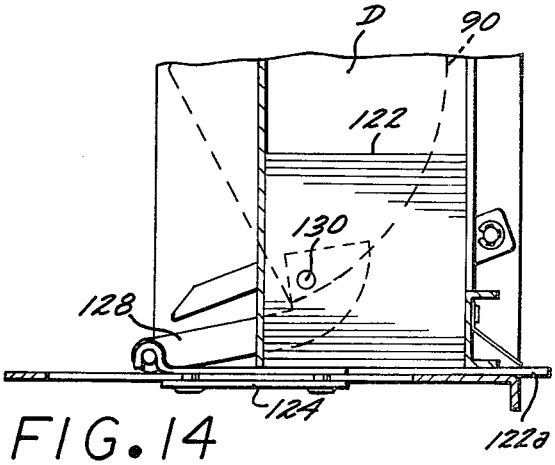
FIG. 14

FIG. 15
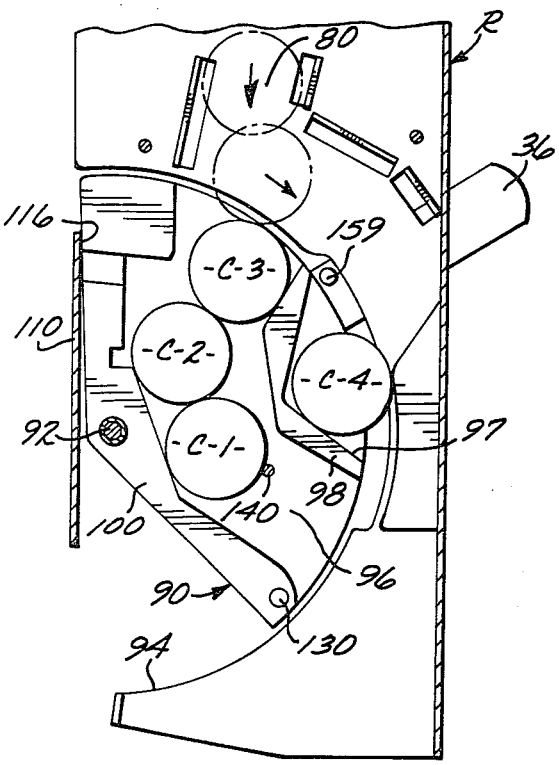
FIG. 16
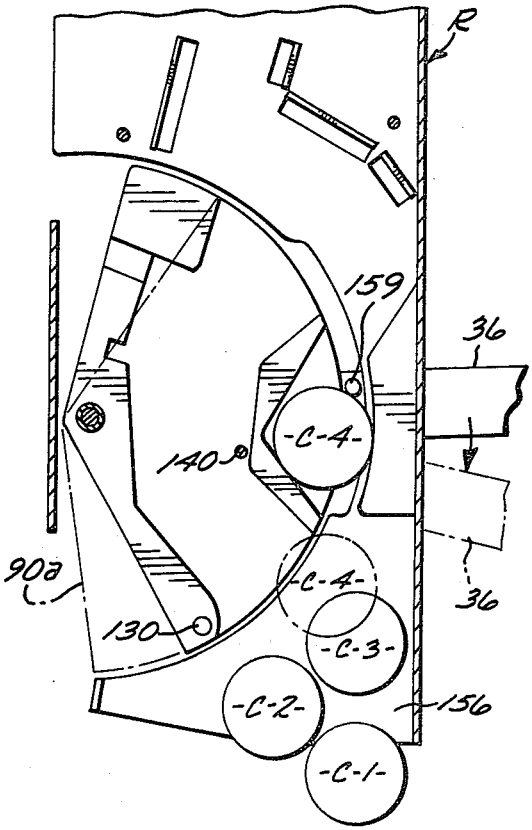
FIG. 17
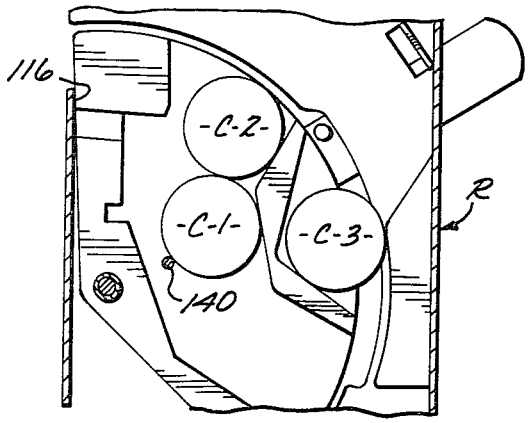
FIG. 18
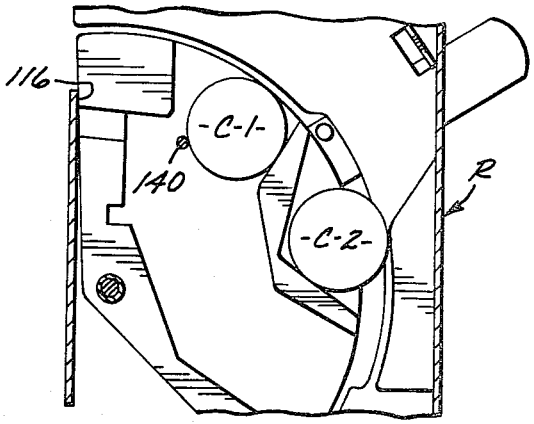
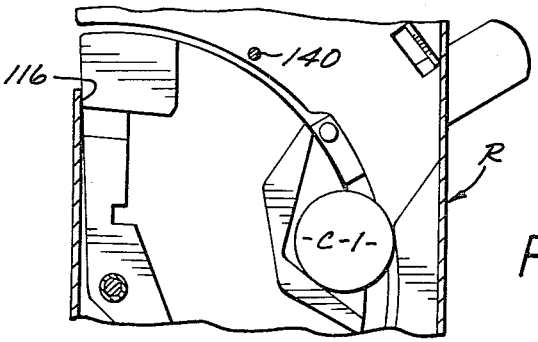
FIG. 19

COIN HANDLING APPARATUS FOR A VENDING MACHINE

BACKGROUND OF THE INVENTION

Heretofore proposed coin-operated stamp vending machines are not adjustable with respect to the number of coins required to dispense one or more given face value stamps. If it becomes desirable to change the number of coins required to effect a dispensing operation, the coin handling apparatus of the present vending machines must be returned to a workover facility. This not only removes the stamp vending machine from operation, but also involves considerable labor and expense. Existing coin-operated stamp vending machines are also subject to a false vend when the stamp dispensing lever is actuated too quickly, resulting in a coin loss. As a natural consequence, the displeasure of the user is incurred. Quite frequently, such user will physically vent his ire on the stamp dispensing machine.

SUMMARY OF THE INVENTION

It is a major object of the present invention to provide a coin handling apparatus for a coin-operated stamp vending machine wherein the number of coins required to effect a dispensing operation can be readily varied without removing the stamp vending machine from its operative location.

A further object of the present invention is to provide a coin handling apparatus for a coin-operated stamp vending machine which prevents a false vend despite the speed at which the stamp dispensing lever is operated.

Yet, a further object of the present invention is to provide coin handling apparatus of the aforedescribed nature which is simple in design and rugged of construction whereby it may afford a long and trouble-free service life, even under adverse conditions.

An additional object of the present invention is to provide coin handling apparatus of the aforedescribed nature which is comparatively inexpensive of manufacture.

Another object of the present invention is to provide coin handling apparatus of the aforedescribed nature which is compact in size and which may be retrofitted on existing stamp vending machines.

A more particular object of the present invention is to provide coin handling apparatus of the aforedescribed nature utilizing a rotatable plate member, formed with a coin discharge chute wherein an adjustment screw may be disposed at selective vertical positions so as to limit the number of coins which may be received within the coin passage.

These and other objects and advantages of the present invention will become apparent from the following detailed description when taken in conjunction with the appended drawings.

DESCRIPTION OF THE DRAWINGS

FIG. 1 is a perspective view of a coin-operated stamp vending machine utilizing coin handling apparatus embodying the present invention;

FIG. 2 is a vertical sectional view taken in enlarged scale along line 2—2 of FIG. 1;

FIG. 3 is a horizontal sectional view taken along line 3—3 of FIG. 2;

FIG. 6 is a vertical sectional view taken in enlarged scale along line 6—6 of FIG. 5;

FIG. 7 is a sectional view taken along line 7—7 of FIG. 6;

FIG. 10 is a sectional view taken along line 10—10 of FIG. 5;

FIG. 11 is a view similar to FIG. 10, but showing the parts thereof disposed in a second position;

FIG. 12 is a vertical sectional view of a stamp dispensing mechanism taken along line 12—12 of FIG. 2;

FIG. 13 is a fragmentary view similar to FIG. 13, but showing the parts thereof in a second position;

FIG. 14 is a view similar to FIG. 13, but showing the parts thereof disposed in a third position;

FIG. 15 is a sectional view of a coin-receiving mechanism taken along line 15—15 of FIG. 6, and showing such coin-receiver mechanism adjusted to receive four coins;

FIG. 16 is a view similar to FIG. 15, but showing the parts thereof in a coin discharging position;

FIG. 17 is a view similar to FIG. 15, but showing the coin-receiver mechanism adjusted to receive three coins;

FIG. 18 is a view similar to FIG. 15, but showing the coin-receiver mechanism arranged to receive two coins; and FIG. 19 is a view similar to FIG. 15, but showing the coin receiver mechanism arranged to receive a single coin.

DETAILED DESCRIPTION

Figure 4:
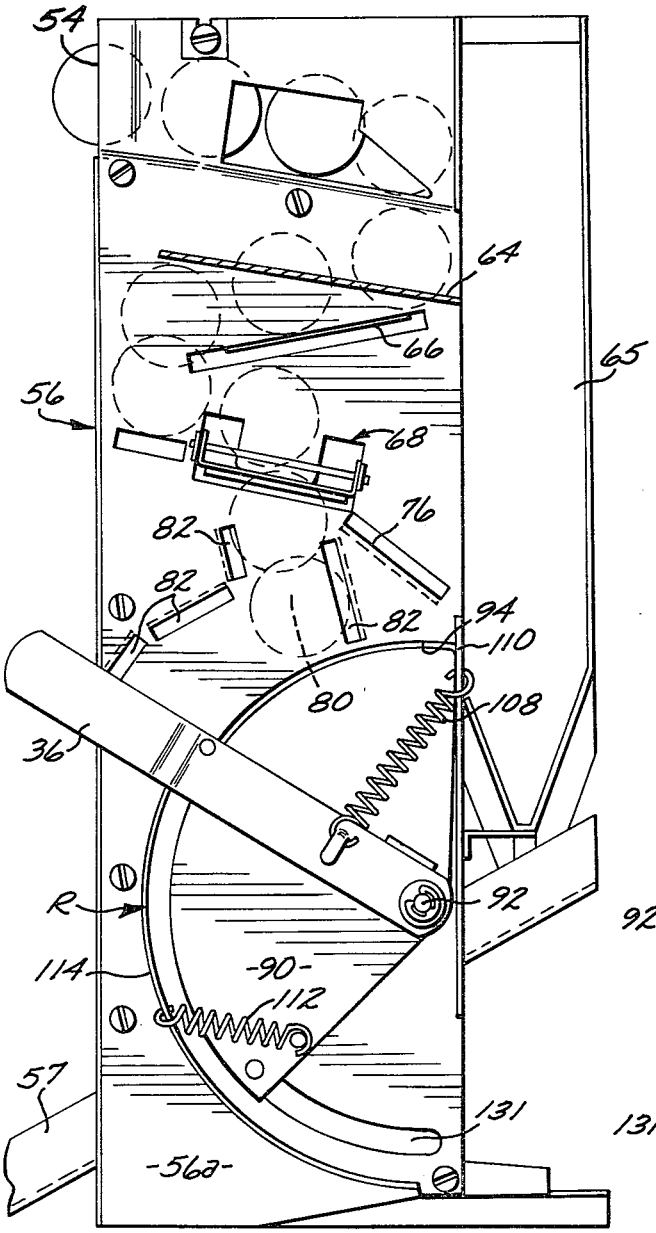
FIG. 4 is a vertical sectional view taken along line 4—4 of FIG. 2.

Referring to the drawings, there is shown a coin-operated stamp vending machine V adapted to utilize a preferred form of coin handling apparatus embodying the present invention. Such vending machine V includes a case, generally designated 30, the front of which is provided with three handles 32, 34 and 36 which are depressed to dispense packets of stamps through horizontal slots 38, 40 and 42. The packets are identifiable as to stamp contents by means of windows 44, 46 and 48, respectively. Coin-receiving slots 50, 52 and 54 are positioned respectively above windows 44, 46 and 48. A conventional coin return 57 is provided at the lower side portion of case 30 opposite a service call information card 58.

Referring to the remaining figures, a preferred form of coin handling apparatus generally designated C is mounted within one side of case 30 for use in conjunction with the right-hand stamp dispensing mechanism of vending machine V, so that actuation of right-hand handle 36 will dispense stamp packets through slot 42 when the appropriate number of coins are deposited in slot 54. Similar coin handling apparatus are provided for use with the stamp dispensing mechanisms operated by handles 32 and 34. However, the latter two coin handling apparatus are not disclosed in the drawings. Coin handling apparatus C includes a double-wall vertical support, generally designated 56, comprised of walls $56^a$ and $56^b$.

Figure 5:
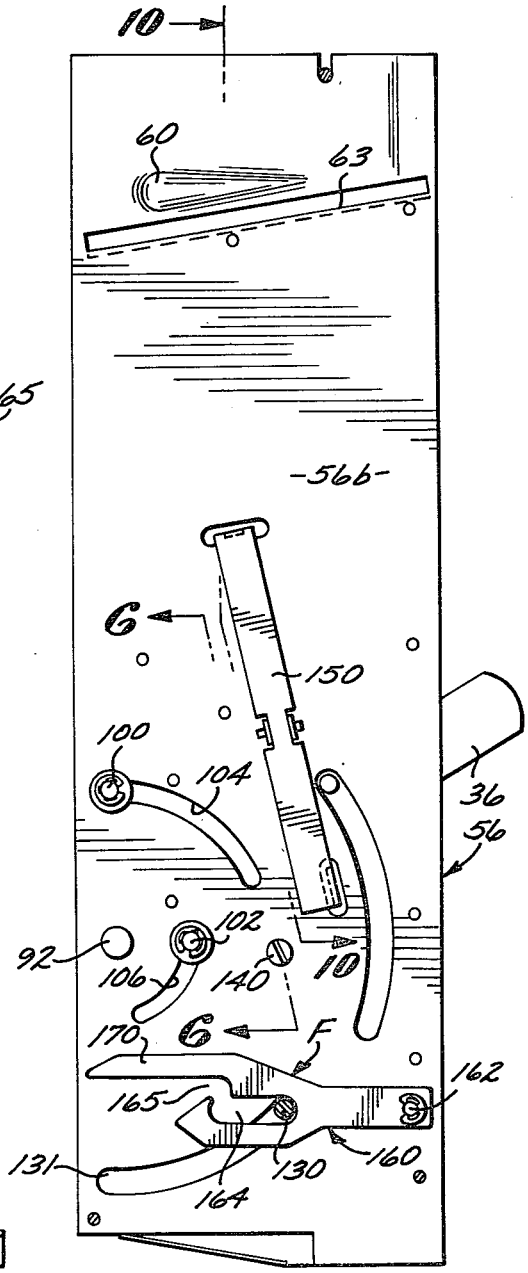
FIG. 5 is a vertical sectional view taken along line 5—5 of FIG. 2.

More particularly and with reference to FIGS. 4 and 5, coins C entering slot 54 are adapted to pass through conventional defective coin rejecting devices. Such devices form no part of the present invention. Referring additionally to FIGS. 10 and 11, the uppermost coin rejection arrangement rejects undersized coins and utilizes a sideward projection 60 stamped upon a vertical wall $56^b$. Opposite projection 60 is located a aperture 62 of a smaller diameter than that required to properly operate the stamp vending machine is formed in wall $56^a$. When an undersized coin rolls downwardly along run 63 of wall $56^b$ it will fall through aperture 63 onto a run 64 affixed to wall $56^a$ and tumble into a coin-reject chute 65 and thence exit through the coin return 57. As indicated by the dotted outlined coins in FIG. 4, however, coins of proper size will pass projection 60 and drop onto a transfer run 66 of plate $56^a$ to thereafter roll to the left and drop onto a counterweight-type coin rejector 68 of conventional construction.

Referring again to FIGS. 10 and 11, such counterweight coin rejector includes a counterweight 70 secured to a lever 71 pivotally attached at its midportion to a bracket 62 secured to wall $56^a$. The end of lever opposite counterweight 70 extends into the space 72 separating wall portion $56^a$ and $56^b$ through an opening 74. The weight of counterweight 70 is so chosen that should an underweight coin move downwardly through space 72 onto the free end of lever 71, such lever will remain in a horizontal position and the underweight coin will roll downwardly past lever 71 and onto a run 76 on wall $56^a$, so as to drop into the lower portion of coin-reject chute 65 and thence through the coin return 57. If, however, the coin is of proper weight it will depress lever 71 and the coin will continue downwardly into the upper end of a feed chute 80 defined by various spacers 82 positioned within space 72.

It is important to note that coin-handling apparatus C is readily adapted to be retrofitted to existing stamp vending machines. Thus, as indicated in FIGS. 2 and 3, the upper end of support 56 is provided with a bracket 86 formed with an elongated slot 88 which receives a mounting bolt 90 secured to case 30. Additionally, bolt 92 may be extended through a bracket 94 secured to the lower portion of the stamp dispensing mechanism S positioned within case 30.

The adjustable coin receiver mechanism of the coin handling apparatus is particularly shown in FIGS. 4 and 15–19 wherein it is generally designated R. Such mechanism includes a vertical plate member of truncated arcuate configuration generally designated 90. Such plate member 90 is horizontally rotatably carried by a horizontal shaft 92 supported by vertical support 56 within an arcuate recess 94 of wall. A generally vertically extending coin passage 96 extends through plate member 90 to receive one or more coins. The upper end of coin passage 96 faces the lower end of the aforedescribed coin feed chute 80 when the plate member is in an initial coin-loading position, such as shown in FIG. 15. Plate member 90 is also formed with a peripheral coin-receiving pocket 97, which is defined by an angled spacer 98 carried by the plate member opposite a second angled spacer 100, also carried by such plate member. It is to be understood that the space between spacers 98 and 100, the interior surface of plate 90 and the interior surface of support wall $56^b$ defines the coin passage 96. To provide extra support for plate member 90, such plate member is provided with upper and lower slide posts 100 and 102 which move within arcuate slots 104 and 106 respectively formed in wall $56^b$, as shown particularly in FIG. 5.

The aforementioned horizontal shaft 92 which is keyed to the mid-portion of plate member 90 is journaled within a suitable bearing 107 extending between walls $56^a$ and $56^b$ as shown in FIG. 7. Such shaft extends through wall $56^a$ where it rotatably supports operating handle 36. As indicated in FIG. 4, a coil tension spring 108 extends between the intermediate portion of handle 36 and a fixed mounting lip 110 on wall $56^a$ to resiliently retain the handle in its upward position. A second coil tension spring 112 is interposed between the lower portion of plate member 90 and a fixed lip 114 on wall $56^a$ to resiliently bias such plate member in an upward direction, i.e. clockwise with respect to FIG. 4 and counter-clockwise with respect to FIGS. 15–19. The upper portion of the plate member abuts lip 110 at the point designated 116 in FIGS. 15, 17, 18 and 19 so as to prevent counter-clockwise rotation of the plate member beyond its position in these figures. The operation of the plate member 90 and its associated parts is described hereinafter.

Referring now particularly to FIGS. 12, 13 and 14, there is shown a stamp dispensing mechanism D positioned within case 30 of stamp vending machine V. The construction of such mechanism is generally conventional. The mechanism includes a vertically extending chamber 120 that extends upwardly from the horizontal slot 42 through which the packets of stamps 122 are singly dispensed. A pusher pad 124 is horizontally slidably carried by a lower bracket 126 formed with a slot 127. Horizontal reciprocation of such pusher pad 124 is effected by means of a crank arm 128 having its lower end pivotally secured to the rear end of pusher pad 124. Posts 125 of pad 124 ride in slot 127. The upper end of crank 128 is attached to a pivot pin 130, which, as indicated in FIGS. 15 and 16, is secured to the lower portion of plate member 90. Pivot pin 130 extends through an arcuate slot 131 formed in support wall $56^b$, as shown in FIGS. 5 and 6. It will be apparent from FIGS. 12 and 13 that as plate member 90 is rotated clockwise from its position of FIG. 15 to its dotted outline position 90A of FIG. 16, the crank arm 128 will first retract pusher pad 124 from its initial position of FIG. 12 to its rearward position of FIG. 13. Referring now to FIG. 14, as plate member 90 is returned in a counter-clockwise direction to its initial position of FIGS. 12 and 15, pusher pad 124 will move forwardly to eject the lowermost stamp packet 122A through slot 42.

In the operation of the coin receiver mechanism R, and referring first to FIG. 15, the mechanism is shown therein adapted for use with four coins of the same denomination. The first coin C-1 will move downwardly from slot 54 through coin feed chute 80 into the lower portion of coin passage 96. Its movement is checked at this point by an adjustable set screw 140 which, as indicated particularly in FIG. 7, extends through support wall $56^b$ into the coin passage 96. The second coin C-2 drops through coin passage 96 into engagement with the upper portion of coin C-1. The third coin C-3 drops into the upper portion of coin passage 96 wherein it rests upon the upper portion of coin C-2. Finally, the fourth coin C-4 drops through feed chute 80 until it contacts the upper portion of coin C-3 whereupon it drops into the confines of pocket 96. When coin C-4 drops into pocket 96 it will effect outward movement of a coin shut-off arm 150 shown particularly in FIGS. 5, 10 and 11. The intermediate portion of coin shut-out arm 150 is pivotally connected at 152 to support wall 56$^b$, while the upper end thereof is formed with an inwardly extending finger 154 which moves through aperture 156 in wall 56$^b$ so as to prevent downward pivotal movement of lever 71 of the counterweight coin rejector 68. Accordingly, should any additional coins be dropped through slot 54, such coins will be caused to roll downwardly past lever 71 onto run 76 into the lower portion of reject chute 65 and thence through the coin return 57. This arrangement prevents overloading of coins, and hence overcharging the user of the vending machine.

With the four coins in their solid outlined position of FIG. 15, the user depresses handle 36 from its initial coin-loading position so as to first move the plate member 90 to its solid outlined position of FIG. 16. Clockwise movement of the plate member is effected through engagement of a horizontal pusher pin 159 formed on the handle 36 just outwardly of plate member with the upper portion of coin C-4. As shown in FIG. 15, pusher pin 159 is positioned at the upper portion of pocket 96 so as to permit access thereto for coin C-4 when the coins are being loaded into the plate member. With the plate member 90 disposed in its position of FIG. 16, coin C-1, C-2 and C-3 will drop through the lower end of coin passage 96 into a coin discharge chute 156 defined within the lower portion of vertical support 56. Such discharge chute empties into a coin box (not shown). Continued downward movement of handle 36 to its coin-unloading position effects further clockwise rotation of plate member 90 to its dotted outlined position of FIG. 16, wherein coin C-4 also drops into coin discharge chute 156.

Referring now to FIG. 17, if the coin receiver mechanism R is to be adjusted for operation with three coins C-1, C-2 and C-3, the adjustment screw 140 is moved from its position of FIGS. 15 and 16 into its raised position within coin passage 96 shown in FIG. 17. In such raised position the coin passage 96 can only receive the two coins designated C-1 and C-2. Operation of the coin receiver mechanism R remains the same.

Referring now to FIG. 18, the coin receiver mechanism R is shown arranged for operation with only two coins, designated C-1 and C-2. It will be observed that the adjustment pin 140 has been raised still further within coin passage 96. In such raised position, only the single coin C-2 is allowed to enter such coin passage.

Finally, referring to FIG. 19 the adjustment screw 140 is shown positioned above the plate member 90 so as to block the upper end of coin passage 96 completely. With this arrangement the coin receiver mechanism R is adapted to be operated with but a single coin C-1, such single coin falling directly from the feed chute 80 into the pocket 97.

Figure 8:
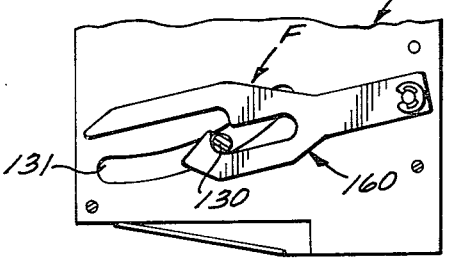
FIG. 8 is a fragmentary view of a fast vend mechanism forming a part of said coin handling apparatus.

As indicated hereinbefore, the preferred form of coin handling apparatus embodying the present invention includes means for preventing a false vend of the stamp packets 122. Such mechanism is termed herein a fast vend mechanism and is designated F in the drawings. Fast vend mechanism F is shown particularly in FIGS. 5, 8 and 10. Referring thereto, such fast vend mechanism includes a generally horizontally extending fast vend lever generally designated 160, having its front end pivotally secured to support 56 by a horizontal pin 162. The intermediate position of lever 160 is formed with a horizontal slot 164 which slidably receives the aforementioned pivot pin 130 carried by plate 90 of the coin receiver mechanism R. The rear portion of slot 164 is formed with an upward opening 165, with such slot terminating at its rear end with a curved catch surface 168. Opening 165 faces the underside of a rearwardly extending finger 170 portion of lever 160.

Figure 9:
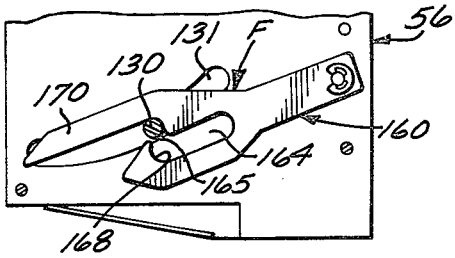
FIG. 9 is a view similar to FIG. 8, but showing the parts thereof disposed in a second position.

In the operation of the fast vend mechanism F, lever 160 will initially be disposed in its horizontally extending position of FIG. 5. At this time, pivot pin 130 will be disposed in the front portion of slot 164. If during stamp dispensing handle 36 is moved downwardly at a normal rate of speed, lever 160 will rotate counter-clockwise under the influence of gravity at a speed approximately equal to the speed at which pin 130 moves through slot 164. When the lever 160 reaches its position of FIG. 8, it will drop into its lowered position of FIG. 9, and pin 130 can continue its dispensing movement through slot 131 to a conclusion. Referring again to FIG. 8, assuming, however, the user depresses handle 36 at a rate of speed likely to result in a false vend, pin 130 will abruptly contact curved catch surface 168 so as to temporarily interupt further downward movement of handle 36. The user will then retract the handle 36 upwardly a short distance, or at least release downward pressure on such handle. Lever 160 will then fall under the influence of gravity in a counter-clockwise direction so as to free pin 130 from its engagement with curved catch surface 168, as indicated in FIG. 9. The user is then free to continue applying downward movement to handle 36 so as to complete a stamp packet dispensing operation.

It should be understood that if handle 36 were permitted to be moved downwardly at an excessive rate of speed without any interuption in such movement, the pusher plate 124 could undergo complete its retraction and return forward movement shown in FIGS. 12, 13 and 14 before the lowermost stamp packet could fall under the influence of gravity into alignment with slot 42. A stamp packet would not be ejected under these circumstances resulting in a false vend. The aforedescribed fast vend mechanism F positively prevents the occurrence of such a false vend.

From the foregoing description it will be observed that the coin handling apparatus embodying the present invention permits the number of coins required to effect a stamp dispensing operation to be readily varied without removing the stamp vending machine V from its operative location. This is accomplished by merely opening case 30 and moving adjustment screw 140 from its initial position and resetting such pin at a position corresponding to those shown in FIGS. 15–19. Such coin handling apparatus moreover, positively prevents a false vend operation. The various objects and advantages of the present invention are accomplished by a simple inexpensive construction which permits retrofitting of existing stamp vending machines with a minimum of time and expense.

Various modifications and changes may be made with respect to the foregoing detailed description without departing from the spirit of the present invention. By way of example, the coin handling apparatus disclosed herein may be utilized with dispensing machines other than those of the stamp dispensing type.

I claim:

1. In a coin-operated vending machine, coin-handling apparatus adjustable to receive single or multiple coins, said coin handling apparatus comprising:

a support attached to said vending machine;

a coin feed chute on said support;

a plate member rotatably carried by said support in communication with said coin feed chute;

a coin discharge chute on said support below said coin feed chute and in communication with said plate member;

a coin passage extending through said plate member to receive one or more coins, one end of said passage facing said coin feed chute when said plate member is in an initial coin loading position;

a coin receiving pocket formed in said plate member intermediately of said coin passage and isolated therefrom, said pocket having a radially outwardly facing opening to receive a coin from said coin feed chute when said plate member is in its coin-loading position;

adjustment means on said support that extend into said coin passage at selective positions so as to limit the number of coins which may be received within said coin passage when said plate member is in its coin-loading position; and means attached to said plate member for rotating said plate member from its coin loading position to a coin unloading position wherein the other end of said coin passage and the opening of said pocket are exposed to said coin discharge chute, and with said rotation moving any coins disposed within said coin passage out of contact with said adjustment means whereby any coins disposed in said coin chute and the coin disposed within said pocket automatically fall into said coin discharge chute.

2. Coin handling apparatus as set forth in claim 1, wherein said adjustment means comprise a pin selectively disposable within any one of a plurality of holes formed in said support in alignment with said coin passage.

3. Coin handling apparatus as set forth in claim 1, wherein said last-mentioned means includes a handle rotatably carried by said support and having a pusher pin that engages a coin disposed in said pocket to effect rotation of said plate member as said handle is moved from an initial coin-loading position to a coin-unloading position.

4. Coin handling apparatus as set forth in claim 3, wherein said plate member and said handle are spring-biased towards their coin-loading positions.

5. Coin handling apparatus as set forth in claim 3, wherein said plate member and said handle are rotatably supported upon the same axis of rotation.

6. Coin handling apparatus as set forth in claim 2, wherein said last-mentioned means includes a handle rotatably carried by said support and having a pusher pin that engages a coin disposed in said pocket to effect rotation of said plate member as said handle is moved from an initial coin-loading position to a coin-unloading position.

7. Coin handling apparatus as set forth in claim 6, wherein said plate member and said handle are rotatably supported upon the same axis of rotation.

8. In a coin-operated vending machine having a packet dispensing mechanism, coin handling apparatus adjustable to receive single or multiple coins, said apparatus comprising:

a support attached to said vending machine;

a coin feed chute on said support;

a plate member rotatably carried by said support in communication with said coin feed chute;

a coin discharge chute on said support below said coin feed chute and in communication with said plate member;

a generally vertically extending coin passage extending through said plate member to receive one or more coins, the upper end of said passage facing said coin feed chute when said plate member is in an initial coin loading position;

a coin receiving pocket formed in said plate member intermediately of said coin passage and isolated therefrom, said pocket having a radially outwardly facing opening to receive coin from said coin feed chute when said plate member is in its coin-loading position;

adjustment means on said support that extend into said coin passage at selective vertical positions so as to limit the number of coins which may be received within said coin passage when said plate member is in its coin-loading position; and means attached to said plate member for rotating said plate member from its coin loading position to a coin unloading position wherein the lower end of said coin passage and the opening of said pocket are exposed to said coin discharge chute, and with said rotation moving any coins disposed within said coin passage out of contact with said adjustment means whereby any coins disposed in said coin chute and coin disposed within said pocket automatically fall into said coin discharge chute; and force-transfer means operatively connecting said plate member and said dispensing mechanism whereby rotation of said plate member between its coin-loading position and its coin-unloading position effects ejection of a packet by said dispensing mechanism.

9. Coin handling apparatus as set forth in claim 8, wherein said force-transfer means includes a handle carried by said support and a pin on said handle, and said coin handling apparatus also includes a fast vend lever horizontally pivotally attached to said support and formed with a slot that receives said pin, one end of said slot having a catch surface which temporarily engages said pin should the latter be moved at a rate of speed exceeding the rate of speed at which said lever moves downwardly under the influence of gravity.

10. Coin handling apparatus as set forth in claim 8, wherein said adjustment means comprise a pin selectively disposable within any one of a plurality of holes formed in said support in alignment with said coin passage.

11. Coin handling apparatus as set forth in claim 8, wherein the means for rotating the plate member includes a handle rotatably carried by said support and having a pusher pin that engages a coin disposed in said pocket to effect rotation of said plate member as said handle is moved from an initial coin-loading position to a coin-unloading position.

12. Coin handling apparatus as set forth in claim 11, wherein said plate member and said handle are spring-biased towards their coin-loading positions.

13. Coin handling apparatus as set forth in claim 12, wherein said plate member and said handle are rotatably supported upon the same axis of rotation.

* * * * *

REEXAMINATION CERTIFICATE (222nd)

United States Patent [19]

Roberts

[11] B1 4,375,255

[45] Certificate Issued Jul. 17, 1984

[54] COIN HANDLING APPARATUS FOR A VENDING MACHINE

[76] Inventor: Glenn M. Roberts, 4169 Avenida Madrid, Cypress, Calif. 90630

Reexamination Request:
No. 90/000,477, Dec. 6, 1983

Reexamination Certificate for:

| | |
|---|---|
| Patent No.: | **4,375,255** |
| Issued: | **Mar. 1, 1983** |
| Appl. No.: | **251,149** |
| Filed: | **Apr. 6, 1981** |

[51] Int. Cl.[3] ..... G07F 5/04
[52] U.S. Cl. ..... 194/1 G; 194/97 R
[58] Field of Search ..... 194/1 C, 1 G, DIG. 2, 194/97 R, DIG. 17, 1 D; 206/63.3

[56] References Cited

U.S. PATENT DOCUMENTS

| | | |
|---|---|---|
| 965,290 | 7/1910 | Garson . |
| 1,146,018 | 7/1915 | Patterson . |
| 1,581,867 | 4/1926 | Ray . |
| 1,947,999 | 2/1934 | McCormick et al. . |
| 2,916,126 | 12/1959 | Shipman . |
| 3,058,613 | 10/1962 | Krakauer et al. . |

OTHER PUBLICATIONS

Shipman Manufacturing Company Postage Stamp Machine's Parts' List, effective Aug. 21, 1972, four pages.
Shipman Manufacturing Company, Inc. "Triplex Deluxe Stamp Machine" booklet, twelve pages, 1977.

*Primary Examiner*—Stanley H. Tollberg

[57] ABSTRACT

A coin handling apparatus for a coin-operated stamp vending machine. The coin handling apparatus is adjustable to permit operation of the vending machine by a single coin or a plurality of coins. This arrangement permits the machine to be set to dispense items of different monetary values. The adjustment of the apparatus with respect to the number of coins required to vend may be easily made in the field so as to eliminate the necessity of removing the vending machine from its operative location. An arrangement is also provided for locking out a coin when the operating lever is moved too quickly. This insures that an item will be dispensed each time the vending machine is operated.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-8 and 10-13 is confirmed.

Claim 9 is determined to be patentable as amended:

9. Coin handling apparatus as set forth in claim 8, wherein said force-transfer means includes a handle carried by said support and a pin on said handle, and said coin handling apparatus also includes a fast vend lever horizontally pivotally attached to said support and formed with a slot that receives [said] *a second* pin, one end of said slot having a catch surface which temporarily engages said pin should the latter be moved at a rate of speed exceeding the rate of speed at which said lever moves downwardly under the influence of gravity.

* * * * *